US009581920B2

(12) United States Patent
Nakamura et al.

(10) Patent No.: US 9,581,920 B2
(45) Date of Patent: Feb. 28, 2017

(54) COATING FILM-REMOVING METHOD FOR CYLINDRICAL SUBSTRATE AND MANUFACTURING METHOD FOR ELECTROPHOTOGRAPHIC PHOTOSENSITIVE MEMBER

(71) Applicant: CANON KABUSHIKI KAISHA, Tokyo (JP)

(72) Inventors: Nobuhiro Nakamura, Numazu (JP); Kazuko Sakuma, Suntou-gun (JP); Takahisa Taniguchi, Toride (JP); Tatsuya Yamaai, Yokohama (JP); Atsushi Fujii, Yokohama (JP); Akihiro Maruyama, Mishima (JP); Atsushi Okuda, Yokohama (JP); Yuka Ishiduka, Suntou-gun (JP); Kazunori Noguchi, Suntou-gun (JP); Yuki Yamamoto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/995,555

(22) Filed: Jan. 14, 2016

(65) Prior Publication Data

US 2016/0216619 A1 Jul. 28, 2016

(30) Foreign Application Priority Data

Jan. 28, 2015 (JP) ..... 2015-014328

(51) Int. Cl.
*G03G 5/05* (2006.01)

(52) U.S. Cl.
CPC ..... *G03G 5/0525* (2013.01); *G03G 5/0503* (2013.01)

(58) Field of Classification Search
CPC ..... G03G 5/0525; G03G 5/0503
See application file for complete search history.

(56) References Cited

FOREIGN PATENT DOCUMENTS

| | | |
|---|---|---|
| JP | 11-212278 A | 8/1999 |
| JP | 2001-205178 A | 7/2001 |

*Primary Examiner* — Hoa V Le
(74) *Attorney, Agent, or Firm* — Fitzpatrick, Cella, Harper & Scinto

(57) ABSTRACT

Provided is coating film-removing method for removing unnecessary coating film on outer peripheral surface of lower side of cylindrical substrate by dip coating, the method comprising: supplying solvent to inside of substrate; causing, through use of outer peripheral surface coating film-removing member configured to remove coating film at portion to be subjected to coating film removal in outer peripheral surface of the substrate, the outer peripheral surface coating film-removing member to abut against region ranging from upper end to lower end of coating film at the portion; and removing, under a state wherein the outer peripheral surface coating film-removing member abuts against the region, the coating film at the portion through rubbing by relatively rotating the substrate and the outer peripheral surface coating film-removing member while supplying the solvent, which is supplied to inside and then flows to lower end of the substrate, to abutting portion.

8 Claims, 8 Drawing Sheets

COATING FILM-REMOVING METHOD FOR CYLINDRICAL SUBSTRATE AND MANUFACTURING METHOD FOR ELECTROPHOTOGRAPHIC PHOTOSENSITIVE MEMBER

BACKGROUND OF THE INVENTION

Field of the Invention

The present invention relates to a coating film-removing method for a cylindrical substrate and a manufacturing method for an electrophotographic photosensitive member.

Description of the Related Art

In an electrophotographic photosensitive member to be used in a copying machine, a laser beam printer, or the like, for example, an electro-conductive layer, an undercoat layer, a charge generating layer, a charge transporting layer, and the like are arranged on a cylindrical substrate. As a manufacturing method for such electrophotographic photosensitive member, there is known a method involving forming, on the substrate, a coating film of a coating liquid for each of the above-mentioned layers constituting the electrophotographic photosensitive member (electrophotographic photosensitive member coating liquid), and heating and curing the coating film. In particular, a dip coating method, which involves dipping the cylindrical substrate in the electrophotographic photosensitive member coating liquid while, for example, an axis of the substrate is in a vertical direction, and then pulling up the substrate to form the coating film, has been widely adopted because of its high productivity. However, in the dip coating method, the coating film is inevitably formed on an outer peripheral surface of a lower side of the substrate as well.

In this connection, the copying machine or the laser beam printer adopts the following construction in some cases: a member (roller) for keeping a constant distance between the electrophotographic photosensitive member and a developing member (such as a developing sleeve) is caused to abut against the electrophotographic photosensitive member. In those cases, a portion against which the roller abuts is subjected to rubbing, and hence the presence of a coating film at such portion involves a problem in that the coating film is nonuniformly peeled or abraded. Therefore, it is necessary that the coating film be not formed at such portion.

Under the above-mentioned circumstances, when the coating film is formed on the cylindrical substrate by the dip coating method, there is required a step of removing an unnecessary coating film on the outer peripheral surface of the lower side of the substrate after coating film formation.

Accordingly, there is a proposal of an apparatus configured to remove a coating film at a lower end portion of a photosensitive member. For example, in Japanese Patent Application Laid-Open No. H11-212278, there is known an apparatus configured to dip a lower end portion of a photosensitive member in a solvent capable of dissolving a coating film and rotate a wiping plate, to thereby remove an unnecessary coating film. In addition, in Japanese Patent Application Laid-Open No. 2001-205178, there is proposed an apparatus configured to discharge a solvent from an apparatus inserted at a lower end on the inside of a cylindrical substrate and rub a coating film with a brush, to thereby remove the coating film.

SUMMARY OF THE INVENTION

According to one aspect of the present invention, there is provided a coating film-removing method for a cylindrical substrate including supporting a cylindrical substrate having formed thereon a coating film of an electrophotographic photosensitive member coating liquid in a vertical direction, and removing the coating film at a portion to be subjected to coating film removal present on a lower side of the substrate in a longitudinal direction through use of a coating film-removing member, the method including:

a solvent-supplying step of supplying a solvent to an inside of the substrate from an opening through which the solvent is discharged;

an outer peripheral surface coating film-removing member abutment step of causing, through use of, as the coating film-removing member, an outer peripheral surface coating film-removing member configured to remove the coating film at the portion to be subjected to coating film removal in an outer peripheral surface of the substrate, the outer peripheral surface coating film-removing member to abut against a region ranging from an upper end to a lower end of the coating film at the portion to be subjected to coating film removal in the outer peripheral surface of the substrate; and an outer peripheral surface coating film-removing step of removing, under a state in which the outer peripheral surface coating film-removing member abuts against the region ranging from the upper end to the lower end of the coating film at the portion to be subjected to coating film removal in the outer peripheral surface of the substrate, the coating film at the portion to be subjected to coating film removal in the outer peripheral surface through rubbing by relatively rotating the substrate and the outer peripheral surface coating film-removing member while supplying the solvent, which is supplied to the inside of the substrate and then flows to the lower end of the substrate, to an abutting portion between the coating film at the portion to be subjected to coating film removal in the outer peripheral surface and the outer peripheral surface coating film-removing member.

According to another aspect of the present invention, there is provided a manufacturing method for an electrophotographic photosensitive member including forming a coating film of an electrophotographic photosensitive member coating liquid on a cylindrical substrate by a dip coating method, the manufacturing method including removing, after the forming the coating film of the electrophotographic photosensitive member coating liquid on the substrate by the dip coating method, the coating film present on a lower side of the substrate in a longitudinal direction by the above-mentioned coating film-removing method for a cylindrical substrate.

Further features of the present invention will become apparent from the following description of exemplary embodiments with reference to the attached drawings.

DESCRIPTION OF THE EMBODIMENTS

Figure 1:
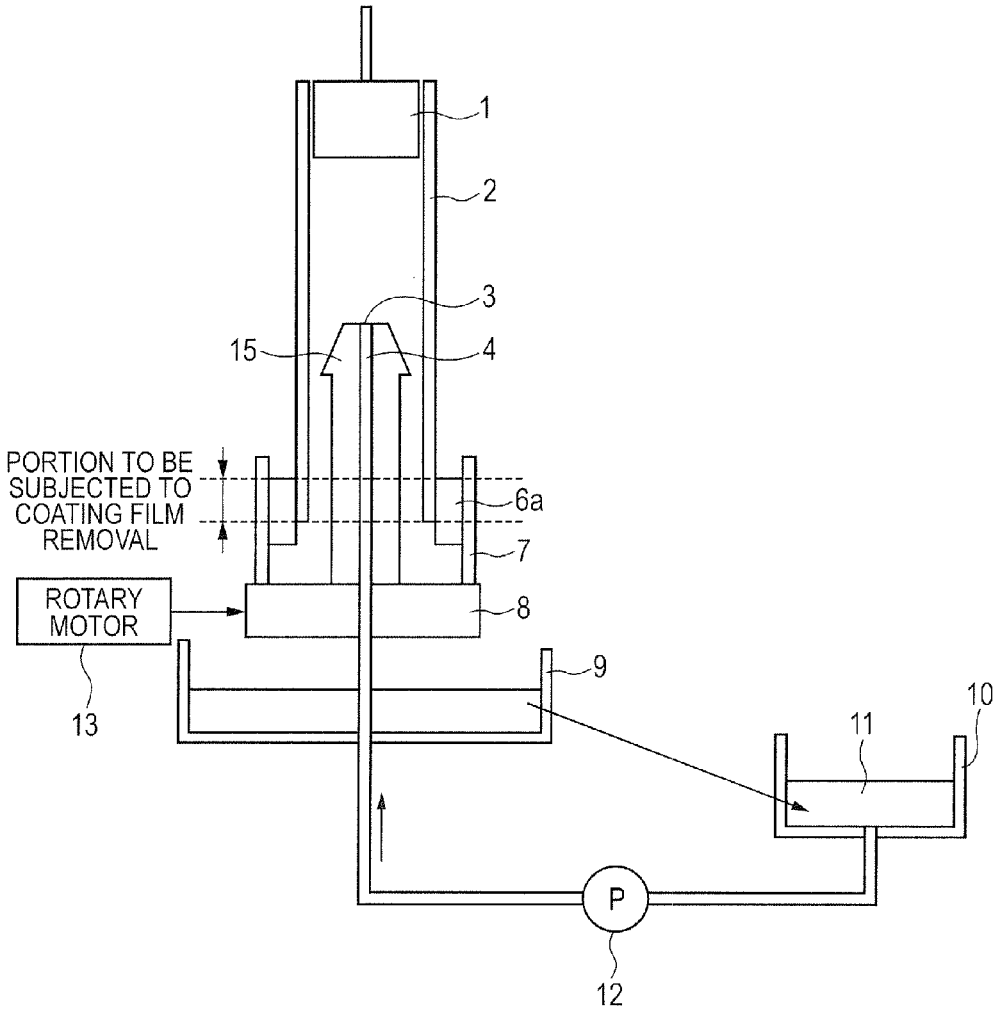
FIG. 1 is a cross-sectional view for illustrating the schematic construction of the entirety of a coating film-removing apparatus to be used in a coating film-removing method of the present invention.

In the removal of a coating film, it is desired to accurately remove a coating film to be removed on the outer peripheral surface of the lower side of a substrate without influencing any other coating film not to be removed. However, as a result of investigations made by the inventors of the present invention, it has been found that there is still room for improvement in such apparatus as described above.

The present invention is directed to providing a coating film-removing method for a cylindrical substrate which allows easy and accurate removal of an unnecessary coating film on the outer peripheral surface of the lower side of a cylindrical substrate having a coating film of an electrophotographic photosensitive member coating liquid formed by a dip coating method with a small influence on a coating film formed at any other portion, and a manufacturing method for an electrophotographic photosensitive member.

According to one aspect of the present invention, there is provided a coating film-removing method for a cylindrical substrate including supporting a cylindrical substrate having formed thereon a coating film of an electrophotographic photosensitive member coating liquid in a vertical direction, and removing the coating film at a portion to be subjected to coating film removal present on a lower side of the substrate in a longitudinal direction through use of a coating film-removing member, the method having a feature of including the following three steps.

The first step is a solvent-supplying step of supplying a solvent to an inside of the substrate from an opening through which the solvent is discharged.

The second step is an outer peripheral surface coating film-removing member abutment step of causing, through use of, as the coating film-removing member, an outer peripheral surface coating film-removing member configured to remove the coating film at the portion to be subjected to coating film removal in an outer peripheral surface of the substrate, the outer peripheral surface coating film-removing member to abut against a region ranging from an upper end to a lower end of the coating film at the portion to be subjected to coating film removal in the outer peripheral surface of the substrate.

In addition, the third step is an outer peripheral surface coating film-removing step of removing, under a state in which the outer peripheral surface coating film-removing member abuts against the region ranging from the upper end to the lower end of the coating film at the portion to be subjected to coating film removal in the outer peripheral surface of the substrate, the coating film at the portion to be subjected to coating film removal in the outer peripheral surface through rubbing by relatively rotating the substrate and the outer peripheral surface coating film-removing member while supplying the solvent, which is supplied to the inside of the substrate and then flows to the lower end of the substrate, to an abutting portion between the coating film at the portion to be subjected to coating film removal in the outer peripheral surface and the outer peripheral surface coating film-removing member.

Now, the present invention is described in detail with reference to the drawings.

A coating film-removing apparatus to be used in the coating film-removing method of the present invention is described by taking FIG. 1 as an example. FIG. 1 is a cross-sectional view for illustrating the schematic construction of the entirety of the coating film-removing apparatus to be used in the coating film-removing method of the present invention.

As illustrated in FIG. 1, the coating film-removing apparatus to be used in the coating film-removing method of the present invention includes a substrate-holding member 1 configured to support a cylindrical substrate 2 having formed thereon a coating film in a vertical direction. In addition, the coating film-removing apparatus includes a coating film-removing mechanism configured to remove a coating film formed on the outer peripheral surface of the lower side of the substrate 2 supported by the substrate-holding member 1 in a longitudinal direction.

The coating film-removing mechanism includes a supporting base 8, and the supporting base 8 has: a shaft portion 15 erected perpendicularly so that the shaft portion 15 can be inserted into the substrate 2; and an outer peripheral surface coating film-removing member-holding member 7 configured to hold outer peripheral surface coating film-removing members 6*a*. Through the rotation of the supporting base 8 by a rotary motor 13, the shaft portion 15 and the outer peripheral surface coating film-removing member-holding member 7 can be integrally rotated about the axis line of the shaft portion 15.

The outer peripheral surface coating film-removing member-holding member 7 has mounted thereon the outer peripheral surface coating film-removing members 6*a* each having a blade shape, and the outer peripheral surface coating film-removing members 6*a* can be caused to abut against the outer peripheral surface of the substrate 2. Under a state in which the outer peripheral surface coating film-removing members 6*a* abut against the outer peripheral surface of the substrate 2, when the supporting base 8 is rotated, the outer peripheral surface coating film-removing members 6*a* rub the outer peripheral surface of the substrate 2, thereby serving a function of removing an unnecessary coating film present on the outer peripheral surface of the substrate.

The shaft portion 15 has on its inside a solvent supply passage 4 penetrating the shaft portion 15, and has at its upper end portion a solvent supply port 3 serving as an opening through which the solvent 11 is discharged. The solvent 11 is sent from a solvent supply tank 10 by a solvent supply pump 12 to the supporting base 8, and is discharged through the solvent supply port 3 via the solvent supply passage 4 arranged on the inside of the shaft portion 15.

In addition, a solvent recovery tank 9 for recovering the solvent 11 discharged through the solvent supply port 3 is arranged and configured such that the used solvent 11 recovered by the solvent recovery tank 9 is sent to the solvent supply tank 10 after, as required, purification and the like, so as to be reutilized.

The series of steps of the coating film-removing method of the present invention are described by taking the coating film-removing apparatus of FIG. 1 as an example.

First, the cylindrical substrate 2 having a coating film formed on its outer peripheral surface by a dip coating method is held by the substrate-holding member 1 in a vertical direction.

Next, the substrate 2 is lowered to a position at which the upper end of a region in which the removal of the coating film is performed (sometimes described as "portion to be subjected to coating film removal") is positioned at the same height as the upper end of each of the outer peripheral surface coating film-removing members 6*a*, and the shaft portion 15 is inserted (outer peripheral surface coating film-removing member abutment step). At this time, the lower end of each of the outer peripheral surface coating film-removing members 6*a* is positioned at the same height as or below the lower end of the substrate 2, and the outer peripheral surface coating film-removing members 6*a* abut against a region ranging from the upper end to the lower end of the coating film at the portion to be subjected to coating film removal in the outer peripheral surface of the substrate 2.

In addition, the solvent supply pump 12 is activated to discharge the solvent 11 through the solvent supply port 3, and thus the solvent 11 is supplied to the inside of the cylindrical substrate 2 (solvent-supplying step).

Then, through the rotation of the supporting base 8 by the rotary motor 13 while the solvent 11 is discharged under the above-mentioned state, the unnecessary coating film is removed through rubbing by rotating the outer peripheral surface coating film-removing members 6*a* caused to abut thereagainst (outer peripheral surface coating film-removing step). After rotation for a predetermined period of time, the substrate 2 is pulled up to complete the series of the coating film-removing steps.

In the coating film-removing method of the present invention, the solvent 11 is supplied by being discharged into the inside of the substrate 2 in the solvent-supplying step. The solvent 11 is transferred to the inner peripheral surface of the substrate 2 via a tapered surface, whose diameter gradually becomes larger toward the lower side, at the upper portion of the shaft portion 15. Then, the solvent 11 runs down the inner peripheral surface of the substrate 2 to reach the lower end portion of the substrate 2, and spreads upward from the lower end portion of the substrate 2 through a gap at the abutting portion between each of the outer peripheral surface coating film-removing members 6*a* and the substrate 2, so as to be supplied to the outer peripheral surface of the substrate 2 on which the removal of the coating film is to be performed. In the method of the present invention, the solvent 11 can be supplied to the abutting portion when the coating film is rubbed by the outer peripheral surface coating film-removing members 6*a*. Accordingly, efficient removal can be performed as compared to a method other than a method involving removing the coating film while supplying the solvent to the abutting portion, such as a method involving removing a coating film with only a solvent which has been caused to permeate a removing member at one time in advance. It should be noted that, in Japanese Patent Application Laid-Open No. 2001-205178, a coating film-removing member shorter than the portion to be subjected to coating film removal in the outer peripheral surface of the substrate is used and a coating film is removed by repeatedly raising and lowering the coating film-removing member. Therefore, the construction of Japanese Patent Application Laid-Open No. 2001-205178 differs from the construction of the present invention in which, under a state in which the outer peripheral surface coating film-removing members abut against a region ranging from the upper end to the lower end of the coating film at the portion to be subjected to coating film removal in the outer peripheral surface of the substrate, the coating film is removed while the solvent is supplied to the abutting portion. Further, in the method of the present invention, the solvent is less liable to spatter to a portion of the coating film which does not need to be removed. Accordingly, accurate removal with little spattering of the solvent can be performed as compared to a method involving directly supplying the solvent to the outer peripheral surface coating film-removing member with a nozzle or the like, or a method involving rubbing while dipping the outer peripheral surface coating film-removing member and the lower end portion of the substrate in the solvent.

It should be noted that, in the series of peeling and removing steps, the solvent 11 may be constantly discharged or may be intermittently discharged during the rubbing of the outer peripheral surface coating film-removing members 6*a* in the outer peripheral surface coating film-removing step. In addition, the solvent 11 may be discharged before or after the outer peripheral surface coating film-removing step, for example, during a period in which the substrate 2 is vertically moved so as to be moved to a predetermined position.

In addition, the solvent supply port 3 may be inserted into the inside of the substrate 2 to supply the solvent 11 as illustrated in FIG. 1, or the solvent may be supplied by being discharged from the outside of the substrate 2 toward the inside of the substrate 2 without the insertion of the solvent supply port 3 into the inside of the substrate 2. It is preferred that the solvent be supplied by inserting the solvent supply port 3 into the inside of the substrate 2 because the solvent does not spatter to the outer peripheral surface of the substrate 2 even when the supply amount of the solvent is increased.

Figure 2A:
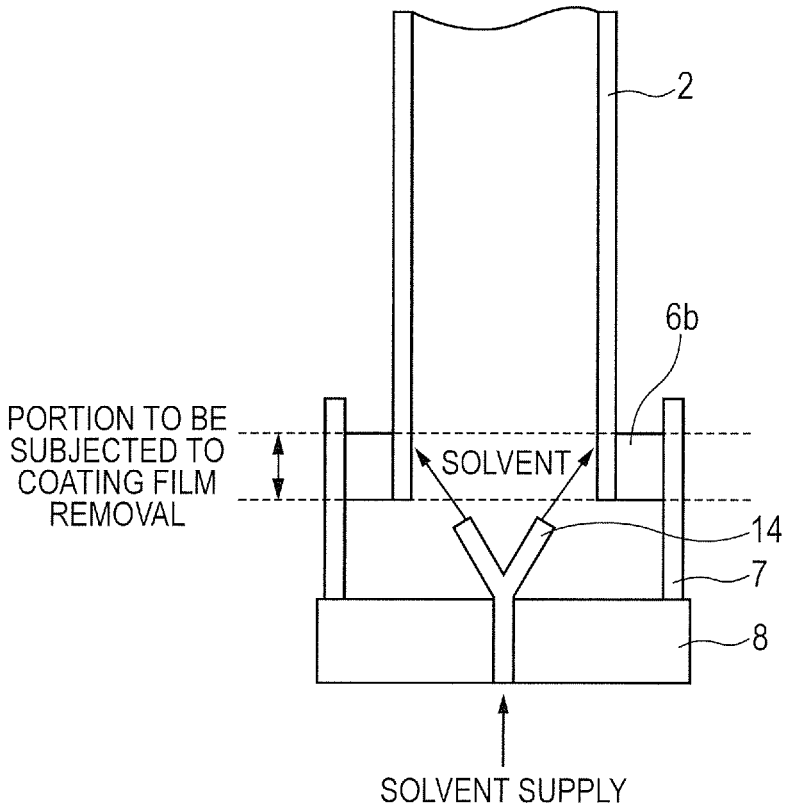
FIG. 2A is a cross-sectional view for illustrating the schematic construction of the vicinity of the removing section of a coating film-removing apparatus to be used in the coating film-removing method of the present invention.
Figure 2B:
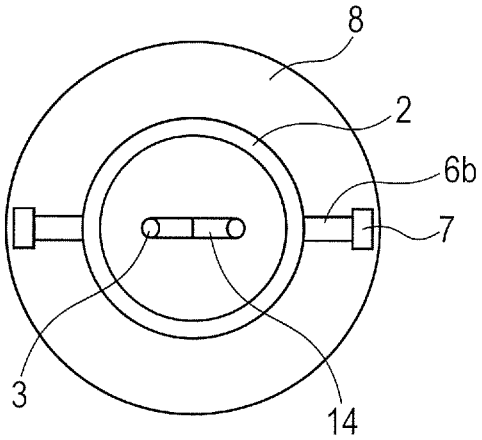
FIG. 2B is a top view for illustrating the schematic construction of the vicinity of the removing section of a coating film-removing apparatus to be used in the coating film-removing method of the present invention.

A specific example in which the solvent is supplied by being discharged from the outside of the substrate 2 toward the inside of the substrate 2 is described with reference to FIG. 2A and FIG. 2B. FIG. 2A and FIG. 2B are a cross-sectional view (FIG. 2A) and a top view (FIG. 2B) for illustrating the schematic construction of the vicinity of the removing section of a coating film-removing apparatus to be used in the coating film-removing method of the present invention. Members like those in FIG. 1 are denoted by like reference symbols, their constructions are like those in FIG. 1, and description thereof is omitted. The coating film-removing apparatus illustrated in FIG. 2A and FIG. 2B includes a solvent supply nozzle 14, and the solvent supply nozzle 14 is arranged on the supporting base 8. In addition, in such coating film-removing apparatus, the solvent sent from the solvent supply tank 10 by the solvent supply pump 12 is discharged through the solvent supply port 3 of the solvent supply nozzle 14, and the solvent 11 is supplied to the inside of the substrate 2. It should be noted that, in FIG. 2A and FIG. 2B, the length of each of the outer peripheral surface coating film-removing members 6*b* in the longitudinal direction of the substrate 2 is substantially the same as the length of the portion to be subjected to coating film removal, and the lower end of each of the outer peripheral surface coating film-removing members 6*b* is positioned at the same height as the lower end of the substrate 2.

The solvent 11 to be used in the coating film-removing method of the present invention is not particularly limited, but is desirably one capable of dissolving or swelling the coating film.

In order for the solvent 11 to spread upward through the gap at the abutting portion between each of the outer peripheral surface coating film-removing members 6*a*, 6*b* and the substrate 2, the abutting position of each of the outer peripheral surface coating film-removing members 6*a*, 6*b* needs to be such that the lower end of each of the outer peripheral surface coating film-removing members 6*a*, 6*b* is positioned at substantially the same height as or below the lower end of the substrate 2. However, even if the lower end of each of the outer peripheral surface coating film-removing members 6*a*, 6*b* is positioned slightly above the lower end of the substrate 2, the effect of the present invention is obtained when the solvent 11 can spread upward around the outer peripheral surface of the substrate 2. It is preferred that the lower end of each of the outer peripheral surface coating film-removing members 6*a*, 6*b* be positioned below the lower end of the substrate 2 because the solvent 11 easily spreads upward through the abutting portion to allow efficient removal of the coating film.

Figure 3A:
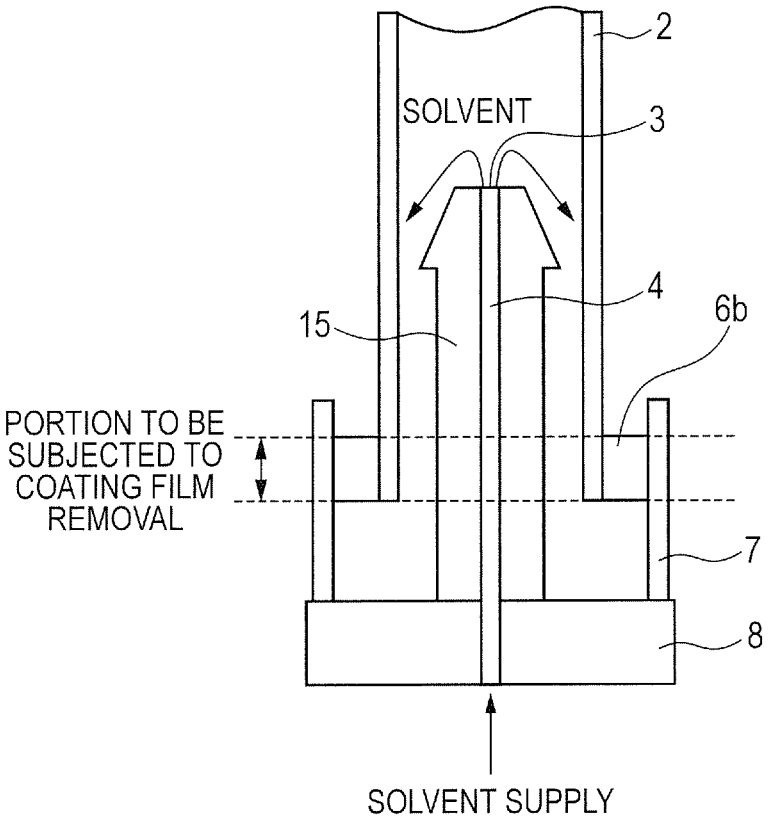
FIG. 3A is a cross-sectional view for illustrating the schematic construction of the vicinity of the removing section of a coating film-removing apparatus to be used in the coating film-removing method of the present invention.
Figure 3B:
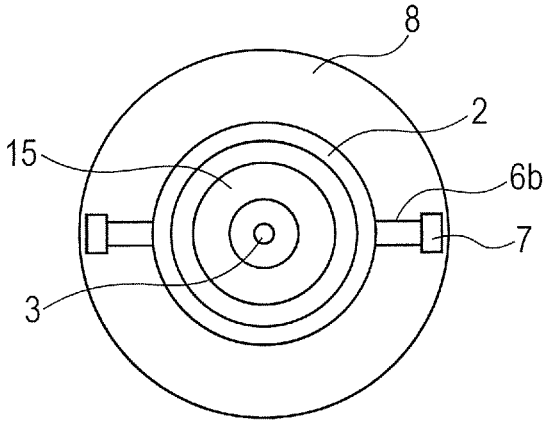
FIG. 3B is a top view for illustrating the schematic construction of the vicinity of the removing section of a coating film-removing apparatus to be used in the coating film-removing method of the present invention.

A specific example in which the abutting position of each of the outer peripheral surface coating film-removing members is such that the lower end of each of the outer peripheral surface coating film-removing members is positioned at substantially the same height as the lower end of the substrate is described with reference to FIG. 3A and FIG. 3B. FIG. 3A and FIG. 3B are a cross-sectional view (FIG. 3A) and a top view (FIG. 3B) for illustrating the schematic construction of the vicinity of the removing section of a coating film-removing apparatus to be used in the coating film-removing method of the present invention. Members like those in FIG. 1 are denoted by like reference symbols, their constructions are like those in FIG. 1, and description thereof is omitted. The coating film-removing apparatus illustrated in FIG. 3A and FIG. 3B includes two outer peripheral surface coating film-removing members 6*b* held by the outer peripheral surface coating film-removing member-holding member 7. The length of each of the outer peripheral surface coating film-removing members 6*b* in the longitudinal direction of the substrate 2 is substantially the same as the length of the portion to be subjected to coating film removal, and the lower end thereof is positioned at substantially the same height as the lower end of the substrate 2.

Figure 4A:
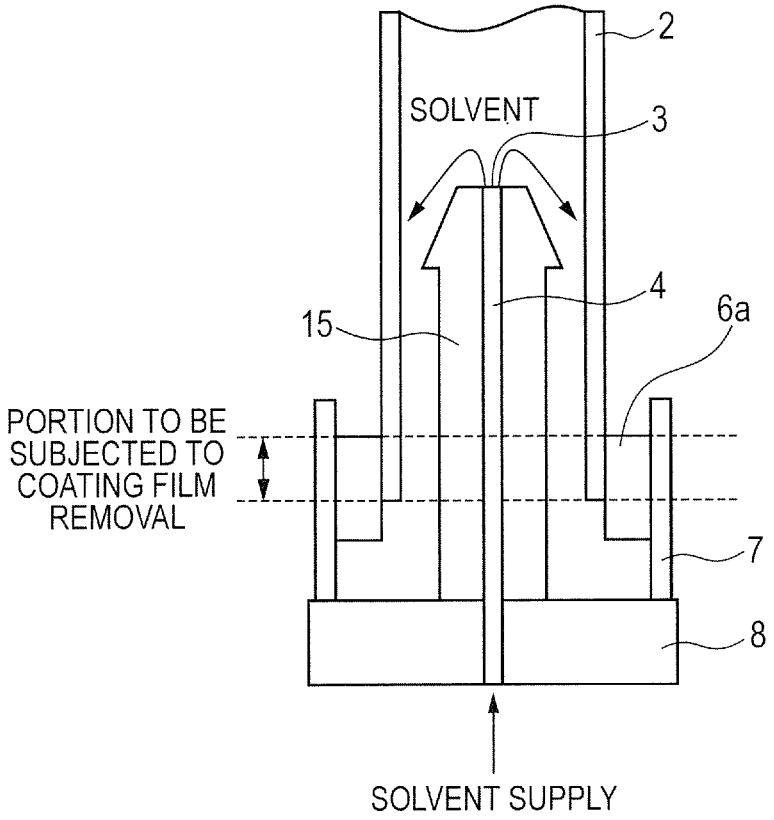
FIG. 4A is a cross-sectional view for illustrating the schematic construction of the vicinity of the removing section of a coating film-removing apparatus to be used in the coating film-removing method of the present invention.
Figure 4B:
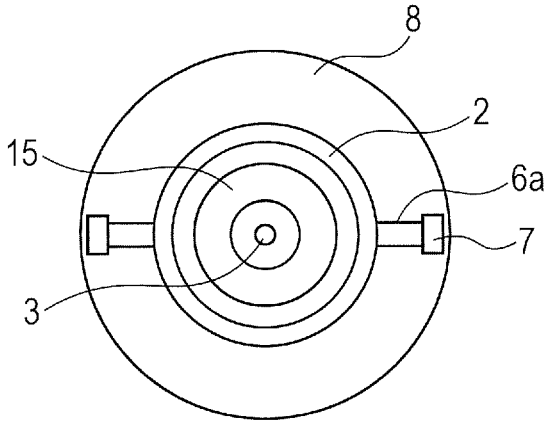
FIG. 4B is a top view for illustrating the schematic construction of the vicinity of the removing section of a coating film-removing apparatus to be used in the coating film-removing method of the present invention.

In addition, a specific example in which the abutting position of each of the outer peripheral surface coating film-removing members is such that the lower end of each of the outer peripheral surface coating film-removing members is positioned below the lower end of the substrate is described with reference to FIG. 4A and FIG. 4B. FIG. 4A and FIG. 4B are a cross-sectional view (FIG. 4A) and a top view (FIG. 4B) for illustrating the schematic construction of the vicinity of the removing section of a coating film-removing apparatus to be used in the coating film-removing method of the present invention. Members like those in FIG. 3A and FIG. 3B are denoted by like reference symbols, their constructions are like those in FIG. 3A and FIG. 3B, and description thereof is omitted. The coating film-removing apparatus illustrated in FIG. 4A and FIG. 4B includes two outer peripheral surface coating film-removing members 6*a* held by the outer peripheral surface coating film-removing member-holding member 7. The length of each of the outer peripheral surface coating film-removing members 6*a* in the longitudinal direction of the substrate 2 is longer than the length of the portion to be subjected to coating film removal, and the lower end thereof is positioned below the lower end of the substrate 2.

When the substrate 2 is lowered to the position at which coating film removal is performed, it is preferred that the outer peripheral surface coating film-removing members 6*a*, 6*b* be retreated by being moved in an outward direction so as to prevent the outer peripheral surface coating film-removing members 6*a*, 6*b* from being brought into contact with the outer peripheral surface of the substrate 2. Accordingly, it is preferred that the outer peripheral surface coating film-removing member-holding member 7 be configured to allow, by a motion mechanism (not shown), the outer peripheral surface coating film-removing members 6*a*, 6*b* to be moved to a position at which contact with the substrate 2 is prevented in the outward direction of radius direction of the substrate 2.

A detailed motion is as described below. While the substrate 2 is moved by being lowered, the outer peripheral surface coating film-removing member-holding member 7 is retreated by being moved in the outward direction of the radius direction of the substrate 2 so as to prevent the outer peripheral surface coating film-removing members 6*a*, 6*b* from being brought into contact with the outer peripheral surface of the substrate 2. Next, the substrate 2 is lowered to a predetermined position and its movement is stopped. After that, the outer peripheral surface coating film-removing member-holding member 7 is moved in the inward direction of the radius direction of the substrate 2 to cause the outer peripheral surface coating film-removing members 6*a*, 6*b* to abut against the outer peripheral surface of the substrate 2, and the supporting base 8 is rotated to perform coating film removal. When the substrate 2 is lowered without moving the outer peripheral surface coating film-removing member-holding member 7 in the outward direction of the radius direction of the substrate 2, the substrate 2 is brought into contact with the upper end portion of each of the outer peripheral surface coating film-removing members 6*a*, 6*b* to press the upper end portion, and hence the outer peripheral surface coating film-removing members 6*a*, 6*b* are liable to be abraded or deformed, with the result that a boundary at which the coating film is to be removed is liable to be disturbed.

A material for each of the outer peripheral surface coating film-removing members 6*a*, 6*b* may be selected in consideration of abrasion resistance and solvent resistance. For example, there may be used: a resin, such as polyethylene, polyester, polypropylene, or polyimide; or a rubber, such as ethylene propylene rubber, ethylene propylene diene rubber, butyl rubber, or fluorine-based rubber.

The shape of each of the outer peripheral surface coating film-removing members 6*a*, 6*b* may be, for example, a blade shape, a brush shape, or a fabric-like form, such as a nonwoven fabric, and may be appropriately selected without any particular limitation. A blade shape is preferred because of, for example, the following reasons: the solvent easily spreads upward through the abutting portion; contamination is hardly accumulated on the coating film-removing members during continuous use; and a boundary between the surface from which the coating film is to be removed and the surface from which the coating film is not to be removed is hardly disturbed.

The shape of each of the outer peripheral surface coating film-removing members 6*a*, 6*b* needs to be a shape whose length is substantially the same as or longer than the length of a region ranging from the boundary between the surface from which the coating film is to be removed and the surface from which the coating film is not to be removed to the lower end of the substrate 2 in the generatrix direction of the substrate in order to supply the solvent 11 to the abutting portion of the outer peripheral surface from the inside of the substrate 2.

Figure 8:
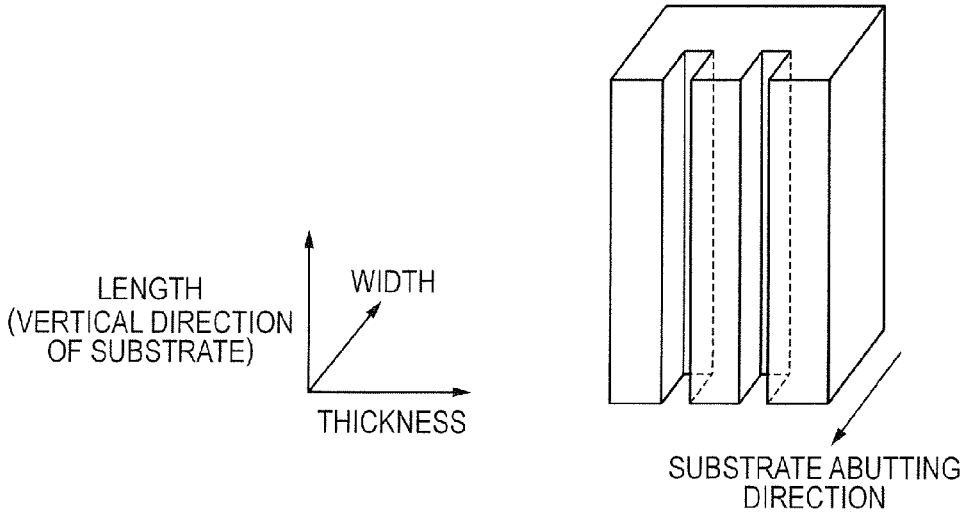
FIG. 8 is a perspective view for illustrating a detailed example of an outer peripheral surface coating film-removing member to be used in the coating film-removing method of the present invention.

In addition, the outer peripheral surface coating film-removing members 6*a*, 6*b* each preferably have such a thickness that an abutting width in the circumference direction of the cylindrical substrate is 1 mm or more in order to increase the amount of the solvent 11 spreading upward to the abutting portion. In addition, in order to increase the abutting width, the shape of the abutting portion may be allowed to have a curvature matched with the curved surface of the substrate. In addition, as illustrated in FIG. 8, the outer peripheral surface coating film-removing members may each have a groove shape in the surface to be caused to abut against the substrate. When a space is formed by the groove shape and the substrate to allow the solvent to spread upward through the space, the amount of the solvent spreading upward can be further increased to enable efficient coating film removal.

Two outer peripheral surface coating film-removing members 6*a*, 6*b* are arranged in FIGS. 2A, 2B, 3A, 3B, 4A, and 4B, but a single outer peripheral surface coating film-removing member may be arranged, or any plurality of outer peripheral surface coating film-removing members may be arranged.

The speed at which the supporting base 8 is rotated by the rotary motor 13 may be appropriately set. A higher rotation speed leads to a shorter period of time required for the removal, but an excessively high rotation speed may cause an excessive load on the coating film-removing members to deform, or make cuts in, the coating film-removing members.

When a plurality of layers are formed on the substrate 2 using the dip coating method, as required, the coating film-removing method of the present invention may be performed for only some layers out of the layers to be formed on the substrate, or may be performed for all the layers. In addition, when the coating film-removing method of the present invention is performed for a plurality of layers, the coating film may be removed every time a coating film for one of the layers is formed, or the coating films may be removed at once after serial formation of some dried coating films.

In order to efficiently remove the coating film on the inner peripheral surface of the lower side of the substrate 2, an inner peripheral surface coating film-removing member may be used as a coating film-removing member in addition to the outer peripheral surface coating film-removing members 6*a*, 6*b*.

The coating film on the inside of the substrate (that is, the coating film on the inner peripheral surface of the substrate) can be removed with a solvent supplied to the inside of the substrate without any use of the inner peripheral surface coating film-removing member, but the coating film can be more precisely removed within a shorter period of time when the inner peripheral surface coating film-removing member is arranged and the coating film is rubbed while the solvent is supplied. In the coating film-removing method of the present invention, the solvent to be supplied to the outer peripheral surface coating film-removing member is supplied by being transferred along the inner surface of the substrate. Therefore, when the inner surface of the substrate is contaminated, a contaminated solvent is supplied to the outer peripheral surface. Accordingly, when the inner peripheral surface coating film-removing member is arranged and the coating film on the inner surface of the substrate is removed precisely within a short period of time, the removal precision of the coating film on the outer peripheral surface becomes satisfactory.

Figure 5A:
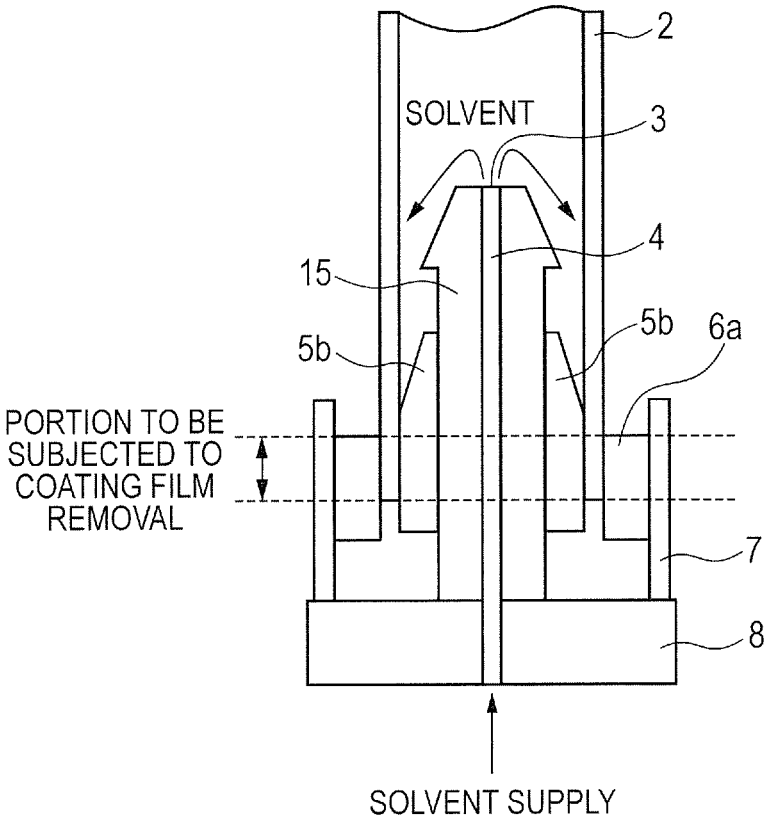
FIG. 5A is a cross-sectional view for illustrating the schematic construction of the vicinity of the removing section of a coating film-removing apparatus to be used in the coating film-removing method of the present invention.
Figure 5B:
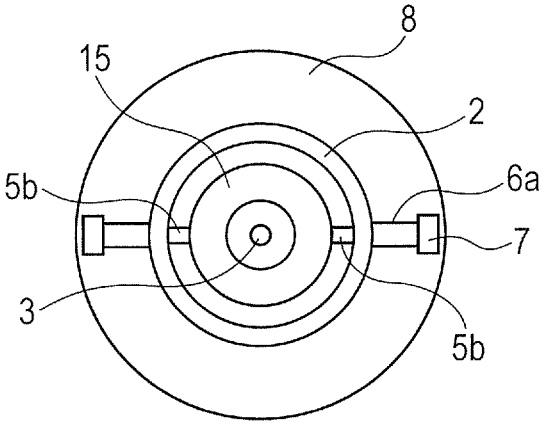
FIG. 5B is a top view for illustrating the schematic construction of the vicinity of the removing section of a coating film-removing apparatus to be used in the coating film-removing method of the present invention.
Figure 6A:
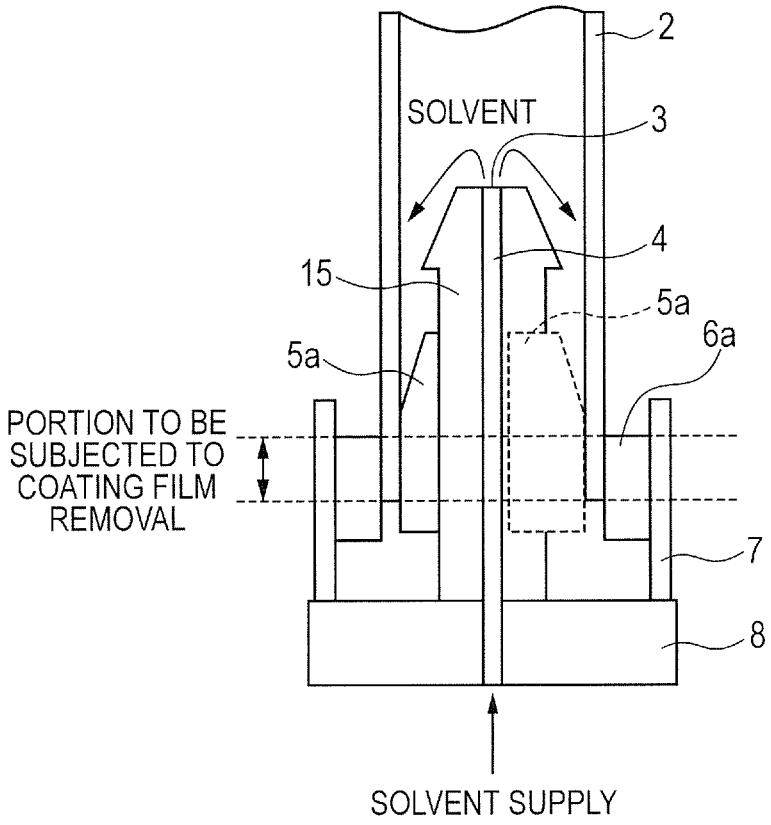
FIG. 6A is a cross-sectional view for illustrating the schematic construction of the vicinity of the removing section of a coating film-removing apparatus to be used in the coating film-removing method of the present invention.
Figure 6B:
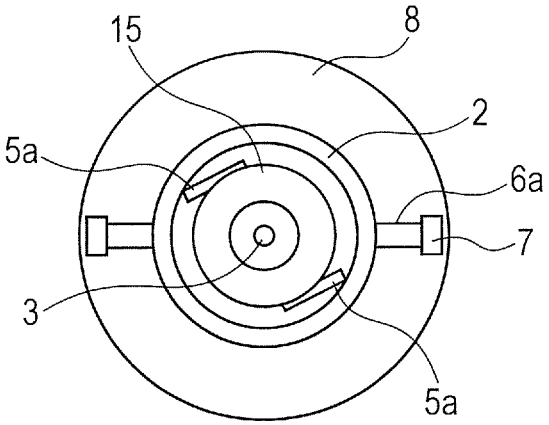
FIG. 6B is a top view for illustrating the schematic construction of the vicinity of the removing section of a coating film-removing apparatus to be used in the coating film-removing method of the present invention.

Examples of the case where the inner peripheral surface coating film-removing member is arranged are described with reference to FIG. 5A, FIG. 5B, FIG. 6A, and FIG. 6B. FIG. 5A and FIG. 5B are a cross-sectional view (FIG. 5A) and a top view (FIG. 5B) for illustrating the schematic construction of the vicinity of the removing section of a coating film-removing apparatus to be used in the coating film-removing method of the present invention. FIG. 6A and FIG. 6B are a cross-sectional view (FIG. 6A) and a top view (FIG. 6B) for illustrating the schematic construction of the vicinity of the removing section of a coating film-removing apparatus to be used in the coating film-removing method of the present invention. In FIG. 5A, FIG. 5B, FIG. 6A, and FIG. 6B, members like those in FIG. 4A and FIG. 4B are denoted by like reference symbols, their constructions are like those in FIG. 4A and FIG. 4B, and description thereof is omitted.

The coating film-removing apparatus illustrated in FIG. 5A and FIG. 5B includes two inner peripheral surface coating film-removing members 5*b*. In addition, the coating film-removing apparatus illustrated in FIG. 6A and FIG. 6B includes two inner peripheral surface coating film-removing members 5*a*. The inner peripheral surface coating film-removing members 5*a*, 5*b* are mounted on the side surface of the shaft portion 15, and are configured to be able to rotate together with the shaft portion 15. The inner peripheral surface coating film-removing members 5*a*, 5*b* are configured to be brought into contact with the inner peripheral surface of the substrate 2 when the shaft portion 15 is inserted into the substrate 2, and serve a function of removing an unnecessary coating film present on the inner peripheral surface of the substrate 2 by rubbing the inner surface of the substrate 2 through the rotation of the supporting base 8 and the shaft portion 15. Therefore, when the coating film-removing method of the present invention is performed using the coating film-removing apparatus illustrated in FIG. 5A and FIG. 5B or FIG. 6A and FIG. 6B, which includes the inner peripheral surface coating film-removing members 5*a*, 5*b*, a step of causing the inner peripheral surface coating film-removing members 5*a*, 5*b* to abut against the coating film at the portion to be subjected to coating film removal in the inner peripheral surface of the substrate 2 (inner peripheral surface coating film-removing member abutment step) may also be performed. In addition, a step of removing, under a state in which the inner peripheral surface coating film-removing members 5*a*, 5*b* abut against the coating film at the portion to be subjected to coating film removal in the inner peripheral surface of the substrate 2, the coating film at the portion to be subjected to coating film removal in the inner peripheral surface through rubbing by relatively rotating the substrate 2 and the inner peripheral surface coating film-removing members 5*a*, 5*b* (inner peripheral surface coating film-removing step) may also be performed. It should be noted that, in FIG. 5A, FIG. 5B, FIG. 6A, and FIG. 6B, the inner peripheral surface coating film-removing members 5*a*, 5*b* are mounted on the shaft portion 15 arranged on the supporting base 8 having the outer peripheral surface coating film-removing members 6*a*, and hence the inner peripheral surface coating film-removing step is performed simultaneously with the outer peripheral surface coating film-removing step.

When the inner peripheral surface coating film-removing members 5*a*, 5*b* are arranged, it is preferred that, as illustrated in FIG. 6A and FIG. 6B, the abutment be such that the abutting portion between the substrate 2 and each of the inner peripheral surface coating film-removing members 5*a*, and the abutting portion between the substrate 2 and each of the outer peripheral surface coating film-removing members 6*a* are present at different positions on the circumference of the substrate 2. In the case where the respective abutting portions are present at the same position on the circumference as in FIG. 5A and FIG. 5B, the amount of the solvent to be supplied to the outer peripheral surface coating film-removing members 6*a* is reduced as compared to the case where the abutting portions are present at different positions as in FIG. 6A and FIG. 6B. Accordingly, from the viewpoint of efficiently removing the coating film on the outer peripheral surface, it is preferred that the respective abutting portions be present at different positions on the circumference.

A material for each of the inner peripheral surface coating film-removing members 5*a*, 5*b* may be selected in consideration of abrasion resistance and solvent resistance. As in the outer peripheral surface coating film-removing members, there may be used: a resin, such as polyethylene, polyester, polypropylene, or polyimide; or a rubber, such as ethylene propylene rubber, ethylene propylene diene rubber, butyl rubber, or fluorine-based rubber.

The shape of each of the inner peripheral surface coating film-removing members 5*a*, 5*b* may be, for example, a blade shape, a brush shape, or a fabric-like form, such as a nonwoven fabric, and may be appropriately selected without any particular limitation. A blade shape is preferred because of, for example, the following reason: contamination is hardly accumulated on the coating film-removing members during continuous use.

Next, a manufacturing method for an electrophotographic photosensitive member of the present invention involving using the coating film-removing method is described.

An electrophotographic photosensitive member to be manufactured by the manufacturing method for an electrophotographic photosensitive member of the present invention includes a cylindrical substrate and a photosensitive layer which is formed on the substrate and contains a charge generating substance and a charge transporting substance. The photosensitive layer may be one obtained by laminating a charge generating layer containing the charge generating substance and a charge transporting layer containing the charge transporting substance in the stated order from the substrate side, or may be one obtained by incorporating the charge generating substance and the charge transporting substance into a single layer. When the photosensitive layer is directly arranged on the substrate, peeling of the photosensitive layer may occur, or a black dot-like or blank dot-like image defect may occur owing to direct reflection of a defect in the surface of the substrate (defect in shape, such as a flaw) into an image. In order to solve those problems, it is preferred that an undercoat layer be present between the photosensitive layer and the substrate.

[Cylindrical Substrate]

The cylindrical substrate is preferably one having electroconductivity (electro-conductive substrate). For example, a substrate made of a metal, such as aluminum, nickel, copper, gold, or iron, or an alloy thereof may be used. Examples thereof include a substrate in which a thin film of a metal, such as aluminum, silver, or gold, is formed on an insulating substrate made of a polyester resin, a polycarbonate resin, a polyimide resin, glass, or the like, and a substrate in which a thin film of an electro-conductive material, such as indium oxide or tin oxide, is formed.

The surface of the cylindrical substrate may be subjected to electrochemical treatment such as anodization, or treatment such as wet honing treatment, blasting treatment, or cutting treatment for improvements in electrical characteristics and the suppression of interference fringes.

[Electro-Conductive Layer (First Intermediate Layer)]

An electro-conductive layer may be formed between the substrate and the undercoat layer. The electro-conductive layer is obtained by: forming, on the substrate, a coating film of an electro-conductive layer coating liquid (first intermediate layer coating liquid) obtained by dispersing electro-conductive particles in a resin; and drying the coating film. Examples of the electro-conductive particles include carbon black, acetylene black, powder of a metal, such as aluminum, nickel, iron, nichrome, copper, zinc, or silver, and powder of a metal oxide, such as electro-conductive tin oxide or ITO.

In addition, examples of the resin include a polyester resin, a polycarbonate resin, a polyvinyl butyral resin, an acrylic resin, a silicone resin, an epoxy resin, a melamine resin, a urethane resin, a phenol resin, and an alkyd resin.

A solvent for the electro-conductive layer coating liquid is, for example, an ether-based solvent, an alcohol-based solvent, a ketone-based solvent, or an aromatic hydrocarbon solvent.

[Undercoat Layer (Second Intermediate Layer)]

For the purposes of suppressing the injection of charge from the substrate side to the photosensitive layer side and suppressing the occurrence of an image defect, such as fogging, the undercoat layer is arranged between the substrate and the photosensitive layer.

The undercoat layer contains a binder resin. From the viewpoints of the suppression of the injection of charge and the suppression of fogging, the undercoat layer may further contain metal oxide particles or an electron transporting substance.

Examples of the binder resin include a polyvinyl acetal resin, a polyolefin resin, a polyester resin, a polyether resin, a polyamide resin, a polyurethane resin, and a polycarbonate resin.

As a production method for the undercoat layer containing the electron transporting substance, for example, first, a coating film of an undercoat layer coating liquid (second intermediate layer coating liquid) containing an electron transporting substance having a polymerizable functional group, a crosslinking agent, and a thermoplastic resin, and in some cases, silica particles is formed. Then, the coating film is dried by heating to polymerize the electron transporting substance having a polymerizable functional group and the crosslinking agent. Thus, the undercoat layer may be formed.

Examples of the electron transporting substance include a quinone compound, an imide compound, a benzimidazole compound, and a cyclopentadienylidene compound. Examples of the polymerizable functional group include a hydroxy group, a thiol group, an amino group, a carboxy group, and a methoxy group. The polymerizable functional group may be directly bonded to a skeleton structure which transports electrons, or may be present in a side chain (substituent bonded to the skeleton structure which transports electrons).

An example of the crosslinking agent is a compound which polymerizes or crosslinks with the electron transporting substance having a polymerizable functional group or the thermoplastic resin. A specific example thereof is a compound described in "Crosslinking Agent Handbook" edited by Shinzo Yamashita and Tosuke Kaneko, and published by Taiseisha Ltd. (1981).

The crosslinking agent to be used in the undercoat layer is preferably an isocyanate compound or an amine compound. An isocyanate compound having 2 to 6 isocyanate groups or blocked isocyanate groups is preferred. Examples thereof include triisocyanatobenzene, triisocyanatomethylbenzene, triphenylmethane triisocyanate, lysine triisocyanate, and an isocyanurate modified product, biuret modified product, allophanate modified product, and trimethylolpropane or pentaerythritol adduct modified product of a diisocyanate, such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanatohexanoate, or norbornane diisocyanate. Of those, an isocyanurate modified product and an adduct modified product are more preferred.

The blocked isocyanate group is a group having a structure represented by —NHCO$X^1$ (where $X^1$ represents a protective group). $X^1$ may represent any protective group as long as the protective group can be introduced into an isocyanate group.

Examples of the thermoplastic resin include a polyvinyl acetal resin, a polyolefin resin, a polyester resin, a polyether resin, and a polyamide resin.

Examples of the silica particles include silica particles obtained by a wet method, such as a sol-gel method or a water glass method, or a dry method, such as a vapor phase method. In addition, the silica particles at the time of their addition may be in a powder form, or the silica particles may be added in a slurry-like state by being dispersed in a solvent.

A solvent to be used in the undercoat layer coating liquid is, for example, an alcohol-based solvent, a sulfoxide-based solvent, a ketone-based solvent, an ether-based solvent, an ester-based solvent, or an aromatic hydrocarbon solvent.

[Charge Generating Layer]

The charge generating layer is arranged on the substrate, on the electro-conductive layer, or on the undercoat layer.

The charge generating layer may be formed by forming a coating film of a charge generating layer coating liquid, which is obtained by dispersing a charge generating substance together with a binder resin and a solvent, and drying the coating film.

As a method for the dispersion, there is given, for example, a method each using a homogenizer, ultrasound, a ball mill, a sand mill, an attritor, or a roll mill.

Examples of the charge generating substance include an azo pigment, a perylene pigment, an anthraquinone derivative, an anthanthrone derivative, a dibenzpyrenequinone derivative, a pyranthrone derivative, a violanthrone derivative, an isoviolanthrone derivative, an indigo derivative, a thioindigo derivative, phthalocyanine pigments, such as a metal phthalocyanine and a metal-free phthalocyanine, and a bisbenzimidazole derivative. Of those, at least one kind selected from an azo pigment and phthalocyanine pigments is preferred. Of the phthalocyanine pigments, oxytitanium phthalocyanine, chlorogallium phthalocyanine, and hydroxygallium phthalocyanine are preferred.

The oxytitanium phthalocyanine is preferably as follows: an oxytitanium phthalocyanine crystal of a crystal form having peaks at Bragg angles (2θ±0.2°) in CuKα characteristic X-ray diffraction of 9.0°, 14.2°, 23.9°, and 27.1°; and an oxytitanium phthalocyanine crystal of a crystal form having peaks at Bragg angles (2θ±0.2°) in CuKα characteristic X-ray diffraction of 9.5°, 9.7°, 11.7°, 15.0°, 23.5°, 24.1°, and 27.3°.

The hydroxygallium phthalocyanine is preferably as follows: a hydroxygallium phthalocyanine crystal of a crystal form having peaks at Bragg angles (2θ±0.2°) in CuKα characteristic X-ray diffraction of 7.3°, 24.9°, and 28.1°; and a hydroxygallium phthalocyanine crystal of a crystal form having intense peaks at Bragg angles (2θ±0.2°) in CuKα characteristic X-ray diffraction of 7.5°, 9.9°, 12.5°, 16.3°, 18.6°, 25.1°, and 28.3°.

Examples of the binder resin to be used in the charge generating layer include: a polymer and copolymer of a vinyl compound, such as styrene, vinyl acetate, vinyl chloride, an acrylic acid ester, a methacrylic acid ester, vinylidene fluoride, or trifluoroethylene; a polyvinyl alcohol resin; a polyvinyl acetal resin; a polycarbonate resin; a polyester resin; a polysulfone resin; a polyphenylene oxide resin; a polyurethane resin; a cellulose resin; a phenol resin; a melamine resin; a silicon resin; and an epoxy resin. Of those, a polyester resin, a polycarbonate resin, and a polyvinyl acetal resin are preferred, and a polyvinyl acetal resin is more preferred.

In the charge generating layer, the mass ratio (charge generating substance/binder resin) of the charge generating substance to the binder resin falls within the range of preferably from 10/1 to 1/10, more preferably from 5/1 to 1/5. The solvent to be used in the charge generating layer coating liquid is, for example, an alcohol-based solvent, a sulfoxide-based solvent, a ketone-based solvent, an ether-based solvent, an ester-based solvent, or an aromatic hydrocarbon solvent.

[Charge Transporting Layer]

The charge transporting layer is arranged on the charge generating layer.

The charge transporting layer may be formed by forming a coating film of a charge transporting layer coating liquid, which is obtained by dispersing a charge transporting substance together with a binder resin and a solvent, and drying the coating film.

The charge transporting substance is roughly classified into a hole transporting substance and the electron transporting substance. Examples of the hole transporting substance include a polycyclic aromatic compound, a heterocyclic compound, a hydrazone compound, a styryl compound, a benzidine compound, a triarylamine compound, triphenylamine, and a polymer having in its main chain or side chain a group derived from any one of these compounds. Of those, a triarylamine compound, a benzidine compound, and a styryl compound are preferred.

Examples of the binder resin to be used in the charge transporting layer include a polyester resin, a polycarbonate resin, a polymethacrylic acid ester resin, a polyarylate resin, a polysulfone resin, and a polystyrene resin. Of those, a polycarbonate resin and a polyarylate resin are preferred.

In the charge transporting layer, the mass ratio (charge transporting substance/binder resin) of the charge transporting substance to the binder resin is preferably from 10/5 to 5/10, more preferably from 10/8 to 6/10.

The solvent to be used in the charge transporting layer coating liquid is, for example, an alcohol-based solvent, a sulfoxide-based solvent, a ketone-based solvent, an ether-based solvent, an ester-based solvent, or an aromatic hydrocarbon solvent.

A manufacturing method for such electrophotographic photosensitive member involves subjecting a cylindrical substrate to dip coating in electrophotographic photosensitive member coating liquids for forming respective layers constituting the electrophotographic photosensitive member (electro-conductive layer coating liquid, undercoat layer coating liquid, charge generating layer coating liquid, and charge transporting layer coating liquid). For example, the cylindrical substrate is dipped in the coating liquid so as to have its axis in a vertical direction and is pulled up, and thus a coating film of the coating liquid is formed on the substrate.

After the formation of the coating film, the coating film at the portion to be subjected to coating film removal, which is the unnecessary coating film formed on the lower side of the substrate in a longitudinal direction, is removed by the coating film-removing method of the present invention.

After the removal of the coating film at the portion to be subjected to coating film removal, the remaining coating film is heated or cured to form each layer.

Coating film removal may be performed every time one layer of a coating film is formed by the dip coating method, or some dried coating films may be serially formed and then removed at once. It should be noted that, in the manufacturing method for an electrophotographic photosensitive member of the present invention, the coating film-removing method of the present invention only needs to be used in the formation of at least one layer. Any other layer may be formed by heating or curing after the formation of a coating film by a coating method other than the dip coating method, such as a spray coating method, a curtain coating method, or a spin coating method, or may be formed by vapor deposition or the like.

EXAMPLES

Now, the present invention is specifically described by way of Examples. However, the present invention is not limited to Examples.

Evaluation was performed as follows: an electro-conductive layer coating liquid, an undercoat layer coating liquid, a charge generating layer coating liquid, or a charge transporting layer coating liquid having composition shown in the following Examples was used for dip coating on a cylindrical substrate made of aluminum, the removal of coating films on the outer peripheral surface of the lower side of the cylindrical substrate was performed, and the degree of removal of the coating films on the outer peripheral surface of the substrate was visually observed.

Example 1

An aluminum cylinder (JIS-A3003, aluminum alloy) having a length of 260.5 mm and an outer diameter of 30 mm was used as the substrate 2 (electro-conductive substrate).

(Preparation of Undercoat Layer Coating Liquid 1)

10 Parts of an electron transporting substance represented by the following formula (A11), 13.5 parts of a blocked isocyanate compound (trade name: SBN-70D, manufactured by Asahi Kasei Chemicals Corporation), 1.5 parts of a polyvinyl acetal resin (trade name: KS-5Z, manufactured by Sekisui Chemical Co., Ltd.) serving as a resin, and 0.05 part of zinc(II) hexanoate (trade name: Zinc(II) Hexanoate, manufactured by Mitsuwa Chemicals Co., Ltd.) serving as a catalyst were dissolved in a mixed solvent of 100 parts of 1-methoxy-2-propanol and 100 parts of tetrahydrofuran to prepare a solution. To the solution, 3.3 parts of an organic solvent-dispersed colloidal silica slurry having an average primary particle diameter of from nm to 15 nm (trade name: IPA-ST-UP, manufactured by Nissan Chemical Industries, Ltd.) was added as an additive, and the mixture was stirred for 1 hour to prepare an undercoat layer coating liquid 1.

(A11)

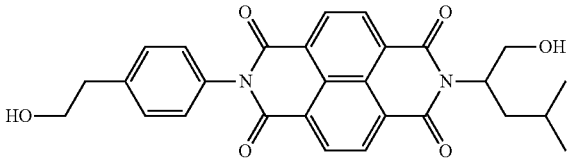

The undercoat layer coating liquid 1 was used for dip coating on the cylindrical substrate 2 made of aluminum to form a coating film. It should be noted that the film thickness of the coating film was adjusted so that a layer to be obtained when the coating film was heated at 160° C. for 40 minutes to be cured (polymerized) had a film thickness (thickness) at its central portion of 0.5 μm. After that, the removal of the coating film on the outer peripheral surface of the lower side of the substrate was performed as described below.

As a coating film-removing apparatus, there was used an apparatus which, as illustrated in FIG. 2A and FIG. 2B, included two outer peripheral surface coating film-removing members 6*b* and was configured such that the solvent was supplied from the outside of the substrate 2 to the inside of the substrate through the solvent supply nozzle 14. As each of the outer peripheral surface coating film-removing members 6*b*, there was used a rubber blade made of ethylene propylene diene rubber having a length of 15 mm, a width of 10 mm, and a thickness of 3 mm (width of an abutting portion of 3 mm).

First, the outer peripheral surface coating film-removing members 6*b* were retreated in the outward direction of the radius direction so as to prevent, when the substrate 2 was lowered, contact therewith. Next, the substrate 2 subjected to the dip coating with the undercoat layer coating liquid 1 was lowered while being supported in a vertical direction.

The lowering of the substrate 2 was stopped at a position at which the upper ends of the outer peripheral surface coating film-removing members 6*b* were aligned at a position 15 mm away from the lower end of the substrate 2 so that the outer peripheral surface coating film-removing members 6*b* abutted against a region of 15 mm from the lower end of the substrate 2. Then, the outer peripheral surface coating film-removing members 6*b*, which had been retreated in the outward direction, were moved in the inward direction of the radius direction to cause the outer peripheral surface coating film-removing members 6*b* to abut against the outer peripheral surface of the substrate 2. At this time, the position of the lower end of each of the outer peripheral surface coating film-removing members 6*b* and the position of the lower end of the substrate 2 were in alignment. While the solvent 11 was discharged from the solvent supply nozzle 14 toward the inner peripheral surface of the substrate, the removal of the coating film was performed through rubbing by rotating the outer peripheral surface coating film-removing members 6*b* at a speed of 40 rpm for 30 seconds. Cyclohexanone was used as the solvent 11.

The procedure was repeated to perform the formation of a coating film of an undercoat layer coating liquid by the dip coating method and the removal of the coating film for a total of 20 substrates. In addition, the formation of a coating film by the dip coating method and the removal of the coating film were performed for 20 substrates in each case in the same manner as that described above except that the rotation time was changed to 40 seconds or 60 seconds. It should be noted that, in the removal of the coating film, the solvent 11 spread upward through the gap at the abutting portion between each of the outer peripheral surface coating film-removing members 6*b* and the substrate 2, and the solvent 11 was constantly supplied to the abutting portion during the removal of the coating film by rubbing with the outer peripheral surface coating film-removing members 6*b*. The result of the visual observation of the degree of removal of the coating film in a region ranging from the lower end of the outer peripheral surface of the substrate to a position of 15 mm is shown in Table 1. The degree of removal was ranked as described below. In Example 1, such a liquid splash that the solvent spattered to a portion of the coating film which did not need to be removed was slightly observed.

A: No wiping residue of the coating film can be found, and hence the degree of removal is extremely satisfactory.

B: A wiping residue of the coating film is hardly found, and hence the degree of removal is satisfactory.

C: A wiping residue of the coating film is found.

Example 2

Preparation of Undercoat Layer Coating Liquid 2

10 Parts of an electron transporting substance represented by the following formula (A12), 13.5 parts of a blocked isocyanate compound (trade name: SBN-70D, manufactured by Asahi Kasei Chemicals Corporation), 1.5 parts of a polyvinyl acetal resin (trade name: KS-5Z, manufactured by Sekisui Chemical Co., Ltd.) serving as a resin, and 0.05 part of zinc(II) hexanoate (trade name: Zinc(II) Hexanoate, manufactured by Mitsuwa Chemicals Co., Ltd.) serving as a catalyst were dissolved in a mixed solvent of 100 parts of 1-methoxy-2-propanol and 100 parts of tetrahydrofuran to prepare an undercoat layer coating liquid 2.

(A12)

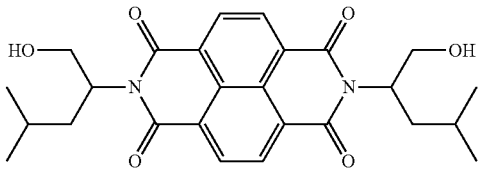

The undercoat layer coating liquid 2 was used for dip coating on the cylindrical substrate 2 made of aluminum to form a coating film. It should be noted that the film thickness of the coating film was adjusted so that a layer to be obtained when the coating film was heated at 160° C. for 40 minutes to be cured (polymerized) had a film thickness at its central portion of 0.5 μm. After that, the removal of the coating film on the outer peripheral surface of the lower side of the substrate 2 was performed as described below.

As a coating film-removing apparatus, there was used an apparatus which, as illustrated in FIG. 3A and FIG. 3B, included two outer peripheral surface coating film-removing members 6*b* and was configured such that the solvent 11 was supplied from the inside of the substrate 2 through the solvent supply port 3 present at the upper end of the shaft portion 15. As each of the outer peripheral surface coating film-removing members 6*b*, there was used a rubber blade made of ethylene propylene diene rubber having a length of 15 mm, a width of 10 mm, and a thickness of 3 mm (width of an abutting portion of 3 mm).

A coating film-removing method was performed in the same manner as in Example 1 except for using the coating film-removing apparatus illustrated in FIG. 3A and FIG. 3B as described above, and evaluation was similarly performed. It should be noted that, in the removal of the coating film, the solvent 11 spread upward through the gap at the abutting portion between each of the outer peripheral surface coating film-removing members 6*b* and the substrate 2, and the solvent 11 was constantly supplied to the abutting portion during the removal of the coating film by rubbing with the outer peripheral surface coating film-removing members 6*b*. The result of the visual observation of the degree of removal of the coating film on the outer peripheral surface of the substrate is shown in Table 1.

Example 3

As a coating film-removing apparatus, there was used an apparatus which, as illustrated in FIG. 4A and FIG. 4B, included two outer peripheral surface coating film-removing members 6*a* and was configured such that the solvent 11 was supplied from the inside of the substrate 2 through the solvent supply port 3 present at the upper end of the shaft portion 15. As each of the outer peripheral surface coating film-removing members 6*a*, there was used a rubber blade made of ethylene propylene diene rubber having a length of 20 mm, a width of 10 mm, and a thickness of 3 mm (width of an abutting portion of 3 mm).

First, the outer peripheral surface coating film-removing members 6*a* were retreated in the outward direction of the radius direction so as to prevent, when the substrate 2 was lowered, contact therewith. Next, the substrate 2 subjected to the dip coating with a coating liquid to form a coating film was lowered while being supported in a vertical direction in the same manner as in Example 1 except for using the undercoat layer coating liquid 2 instead of the undercoat layer coating liquid 1.

The lowering of the substrate 2 was stopped at a position at which the upper ends of the outer peripheral surface coating film-removing members 6*a* were aligned at a position 15 mm away from the lower end of the substrate 2 so that the outer peripheral surface coating film-removing members 6*a* abutted against a region of 15 mm from the lower end of the substrate 2. Then, the outer peripheral surface coating film-removing members 6*a*, which had been retreated in the outward direction, were moved in the inward direction to cause the outer peripheral surface coating film-removing members 6*a* to abut against the substrate 2. At this time, a portion of 5 mm from the lower end of each of the outer peripheral surface coating film-removing members 6*a* extended downward from the lower end of the substrate 2. While the solvent 11 was discharged from the solvent supply port 3 present at the upper end of the shaft portion 15, the removal of the coating film was performed through rubbing by rotating the outer peripheral surface coating film-removing members 6*a* at a speed of 40 rpm for 30 seconds. Cyclohexanone was used as the solvent 11.

The procedure was repeated to perform the formation of a coating film of the undercoat layer coating liquid 2 by the dip coating method and the removal of the coating film for a total of 20 substrates. In addition, the formation of a coating film by the dip coating method and the removal of the coating film were performed for 20 substrates in each case in the same manner as that described above except that the rotation time was changed to 40 seconds or 60 seconds. It should be noted that, in the removal of the coating film, the solvent spread upward through the gap at the abutting portion between each of the outer peripheral surface coating film-removing members 6*a* and the substrate 2, and the solvent 11 was constantly supplied to the abutting portion during the removal of the coating film by rubbing with the outer peripheral surface coating film-removing members 6*a*. The result of the visual observation of the degree of removal of the coating film on the outer peripheral surface of the substrate is shown in Table 1.

Example 4

As a coating film-removing apparatus, there was used an apparatus which, as illustrated in FIG. 5A and FIG. 5B, included two each of the outer peripheral surface coating film-removing members 6*a* and the inner peripheral surface coating film-removing members 5*b* and was configured such that the solvent 11 was supplied from the inside of the substrate 2 through the solvent supply port 3 present at the upper end of the shaft portion 15. In addition, as illustrated in FIG. 5B, the abutting portion between each of the outer peripheral surface coating film-removing members 6*a* and the substrate 2, and the abutting portion between each of the inner peripheral surface coating film-removing members 5*b* and the substrate 2 were present at the same position in the circumference direction. As each of the outer peripheral surface coating film-removing members 6*a*, there was used a rubber blade made of ethylene propylene diene rubber having a length of 20 mm, a width of mm, and a thickness of 3 mm (width of an abutting portion of 3 mm).

The formation of a coating film by the dip coating method and the removal of the coating film were performed in the same manner as in Example 1 except for using the coating film-removing apparatus illustrated in FIG. 5A and FIG. 5B as described above, and evaluation was performed in the same manner as in Example 1. It should be noted that, in the removal of the coating film, the solvent spread upward through the gap at the abutting portion between each of the outer peripheral surface coating film-removing members 6*a* and the substrate 2, and the solvent 11 was constantly supplied to the abutting portion during the removal of the coating film by rubbing with the outer peripheral surface coating film-removing members 6*a*. The result of the visual observation of the degree of removal of the coating film on the outer peripheral surface of the substrate is shown in Table 1.

Example 5

As a coating film-removing apparatus, there was used an apparatus which, as illustrated in FIG. 6A and FIG. 6B, included two each of the outer peripheral surface coating film-removing members 6*a* and the inner peripheral surface coating film-removing members 5*a* and was configured such that the solvent 11 was supplied from the inside of the substrate 2 through the solvent supply port 3 present at the upper end of the shaft portion 15. In addition, as illustrated in FIG. 6B, the abutting portion between each of the outer peripheral surface coating film-removing members 6*a* and the substrate 2, and the abutting portion between each of the inner peripheral surface coating film-removing members 5*a* and the substrate 2 were present at different positions in the circumference direction. As each of the outer peripheral surface coating film-removing members 6*a*, there was used a rubber blade made of ethylene propylene diene rubber having a length of 20 mm, a width of mm, and a thickness of 3 mm (width of an abutting portion of 3 mm).

The formation of a coating film by the dip coating method and the removal of the coating film were performed in the same manner as in Example 1 except for using the coating film-removing apparatus illustrated in FIG. 6A and FIG. 6B as described above, and evaluation was performed in the same manner as in Example 1. It should be noted that, in the removal of the coating film, the solvent spread upward through the gap at the abutting portion between each of the outer peripheral surface coating film-removing members 6*a* and the substrate 2, and the solvent 11 was constantly supplied to the abutting portion during the removal of the coating film by rubbing with the outer peripheral surface coating film-removing members 6*a*. The result of the visual observation of the degree of removal of the coating film on the outer peripheral surface of the substrate is shown in Table 1.

Example 6

Figure 7A:
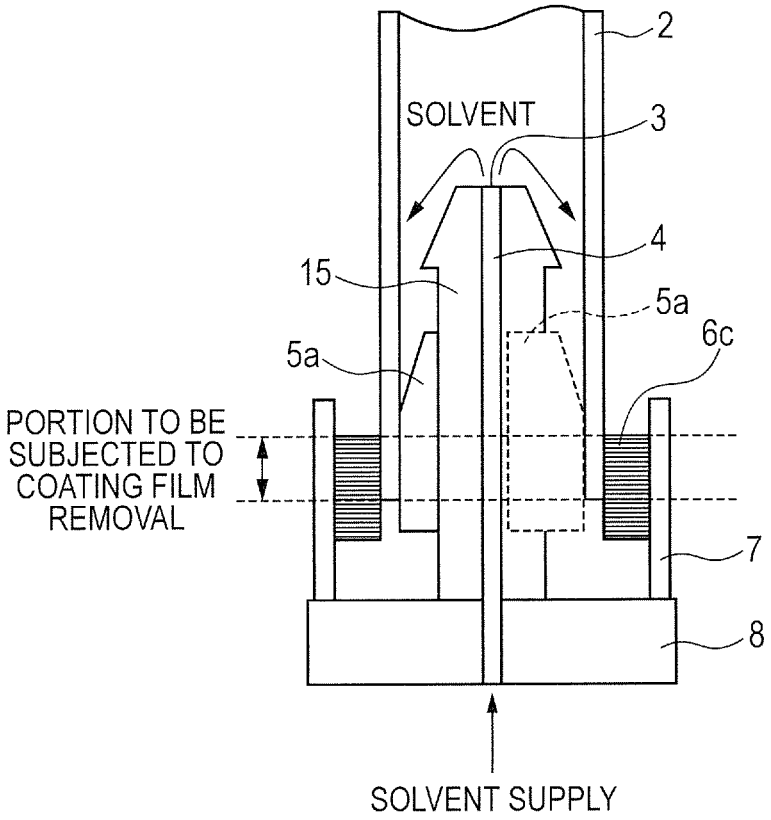
FIG. 7A is a cross-sectional view for illustrating the schematic construction of the vicinity of the removing section of a coating film-removing apparatus to be used in the coating film-removing method of the present invention.
Figure 7B:
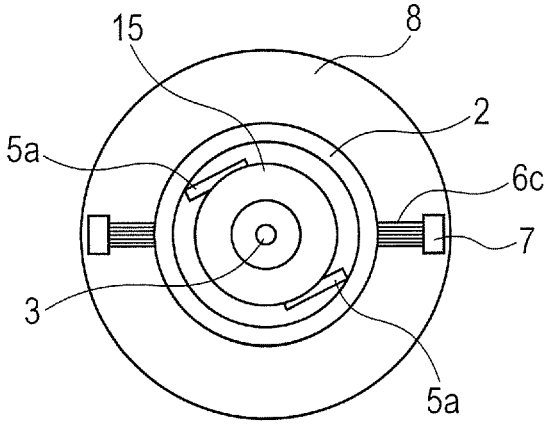
FIG. 7B is a top view for illustrating the schematic construction of the vicinity of the removing section of a coating film-removing apparatus to be used in the coating film-removing method of the present invention.

As a coating film-removing apparatus, there was used a coating film-removing apparatus illustrated in FIG. 7A and FIG. 7B. FIG. 7A and FIG. 7B are a cross-sectional view (FIG. 7A) and a top view (FIG. 7B) for illustrating the schematic construction of the vicinity of the removing section of a coating film-removing apparatus to be used in the coating film-removing method of the present invention. Members like those in FIG. 6A and FIG. 6B are denoted by like reference symbols, their constructions are like those in FIG. 6A and FIG. 6B, and description thereof is omitted. The coating film-removing apparatus illustrated in FIG. 7A and FIG. 7B includes two each of outer peripheral surface coating film-removing members 6*c* mounted on the outer peripheral surface coating film-removing member-holding member 7 and the inner peripheral surface coating film-removing members 5*a* mounted on the shaft portion 15. In addition, the apparatus is configured such that the solvent 11 is supplied from the inside of the substrate 2 through the solvent supply port 3 present at the upper end of the shaft portion 15. As illustrated in the top view of FIG. 7B, the abutting portion between each of the outer peripheral surface coating film-removing members 6*c* and the substrate 2, and the abutting portion between each of the inner peripheral surface coating film-removing members 5*a* and the substrate 2 were present at different positions in the circumference direction. As each of the outer peripheral surface coating film-removing members 6*c*, there was used a brush having a length of 20 mm, a width of 10 mm, and a thickness of 3 mm (width at the abutting portion of 3 mm).

The formation of a coating film by the dip coating method and the removal of the coating film were performed in the same manner as in Example 1 except for using the coating film-removing apparatus illustrated in FIG. 7A and FIG. 7B as described above, and evaluation was performed in the same manner as in Example 1. The result of the visual observation of the degree of removal of the coating film on the outer peripheral surface of the substrate is shown in Table 1. A boundary between the region in which the removal was performed (portion to be subjected to coating film removal) and the region in which the removal was not to be performed in the outer peripheral surface was disturbed by the brushes.

Example 7

The formation of a coating film by the dip coating method and the removal of the coating film were performed in the same manner as in Example 5 except for changing the shape of the outer peripheral surface coating film-removing members 6*a*, and evaluation was performed in the same manner as in Example 5. The result of the visual observation of the degree of removal of the coating film on the outer peripheral surface of the substrate is shown in Table 1. Regarding the shape of each of the outer peripheral surface coating film-removing members 6*a*, a rubber blade made of ethylene propylene diene rubber having the shape illustrated in FIG. 8 was used. The dimensions of the entire rubber blade were 4.5 mm in thickness, 8 mm in width, and 20 mm in length, and the dimensions of each of the two groove shapes were 0.5 mm in thickness and 1.5 mm in width. In addition, regarding the abutting position relationship between each of the outer peripheral surface coating film-removing members 6*a* and the substrate 2, the abutment was such that the surface having the groove shapes abutted against the substrate and each of the two groove shapes formed a space with the substrate. It should be noted that, in the removal of the coating film, the solvent 11 spread upward through the space formed between each of the groove shapes of the outer peripheral surface coating film-removing members 6*a* and the substrate, and the solvent 11 was constantly accumulated in the space during the removal of the coating film by rubbing with the outer peripheral surface coating film-removing members 6*a*.

TABLE 1

| Example | Coating film removal time | Degree of removal | Remark |
|---|---|---|---|
| Example 1 | 30 s | B | A liquid splash was found in only one substrate. |
| | 40 s | B | A liquid splash was found in only one substrate. |
| | 60 s | A | A liquid splash was found in only two substrates. |

TABLE 1-continued

| Example | Coating film removal time | Degree of removal | Remark |
|---|---|---|---|
| Example 2 | 30 s | B | |
| | 40 s | B | |
| | 60 s | A | |
| Example 3 | 30 s | B | |
| | 40 s | A | |
| | 60 s | A | |
| Example 4 | 30 s | B | |
| | 40 s | A | |
| | 60 s | A | |
| Example 5 | 30 s | A | |
| | 40 s | A | |
| | 60 s | A | |
| Example 6 | 30 s | B | The boundary was disturbed. |
| | 40 s | A | The boundary was disturbed. |
| | 60 s | A | The boundary was disturbed. |
| Example 7 | 30 s | A | |
| | 40 s | A | |
| | 60 s | A | |

Example 8

Preparation of Electro-Conductive Layer Coating Liquid

50 Parts of titanium oxide particles (powder resistivity: 120 Ω·cm, coverage ratio of tin oxide: 40%) each covered with oxygen-deficient tin oxide, 40 parts of a phenol resin (Plyophen J-325, manufactured by DIC Corporation, resin solid content: 60%), and 50 parts of methoxypropanol serving as a solvent (dispersion medium) were loaded into a sand mill using glass beads each having a diameter of 1 mm and subjected to dispersion treatment for 3 hours to prepare an electro-conductive layer coating liquid.

The electro-conductive layer coating liquid was used for dip coating on the cylindrical substrate 2 made of aluminum to form a coating film. It should be noted that the film thickness of the coating film was adjusted so that a layer to be obtained when the coating film was dried and thermally cured at 150° C. for 30 minutes had a film thickness at its central portion of 20 μm. After that, the removal of the coating film on the outer peripheral surface of the lower side of the substrate 2 was performed.

A coating film-removing method was performed in the same manner as in Example 5 except for using methoxypropanol as the solvent 11 and setting the removal time to each of 30 seconds and 60 seconds, and evaluation was similarly performed. It should be noted that, in the removal of the coating film, the solvent 11 spread upward through the gap at the abutting portion between each of the outer peripheral surface coating film-removing members 6*a* and the substrate 2, and the solvent 11 was constantly supplied to the abutting portion during the removal of the coating film by rubbing with the outer peripheral surface coating film-removing members 6*a*. The result of the visual observation of the degree of removal of the coating film on the outer peripheral surface of the substrate is shown in Table 2.

Example 9

The electro-conductive layer coating liquid was used for dip coating on the cylindrical substrate 2 made of aluminum to form a coating film. After that, the removal of the coating film on the outer peripheral surface was not performed, and only the removal of the coating film on the inner peripheral surface was performed. The removal of the coating film only on the inner peripheral surface was performed by performing only the following procedure using the coating film-removing apparatus illustrated in FIG. 6A and FIG. 6B: the supporting base 8 was not rotated, the solvent 11 was supplied from the inside of the substrate 2 through the solvent supply port 3 present at the upper end of the shaft portion 15, and the solvent 11 was brought into contact with the inner peripheral surface of the substrate 2. After the removal of the coating film on the inner peripheral surface, the remainder was dried and thermally cured at 150° C. for 30 minutes to form an electro-conductive layer having a film thickness at its central portion of 20 μm.

Next, the undercoat layer coating liquid 1 was used for dip coating on the electro-conductive layer to form a coating film. It should be noted that the film thickness of the coating film was adjusted so that a layer to be obtained when the coating film was heated at 160° C. for 40 minutes to be cured (polymerized) had a film thickness at its central portion of 0.5 μm. After that, the removal of the coating film on the outer peripheral surface of the lower side of the substrate was performed.

A coating film-removing method was performed in the same manner as in Example 5 except for setting the removal time to each of 30 seconds and 60 seconds, and evaluation was similarly performed. It should be noted that, in the removal of the coating film, the solvent 11 spread upward through the gap at the abutting portion between each of the outer peripheral surface coating film-removing members 6*a* and the substrate 2, and the solvent 11 was constantly supplied to the abutting portion during the removal of the coating film by rubbing with the outer peripheral surface coating film-removing members 6*a*. The result of the visual observation of the degree of removal of the coating film of the undercoat layer coating liquid 1 on the outer peripheral surface of the substrate is shown in Table 2.

Example 10

The electro-conductive layer coating liquid was used for dip coating on the cylindrical substrate 2 made of aluminum to form a coating film. After that, the removal of the coating film on the outer peripheral surface was not performed, and only the removal of the coating film on the inner peripheral surface was performed by the same method as in Example 9. The resultant was dried and thermally cured at 150° C. for 30 minutes to form an electro-conductive layer having a film thickness at its central portion of 20 μm.

Next, the undercoat layer coating liquid 1 was used for dip coating on the electro-conductive layer to form a coating film. After that, the removal of the coating film on the outer peripheral surface was not performed, and only the removal of the coating film on the inner peripheral surface was performed by the same method as that in the formation of the electro-conductive layer. The resultant was heated at 160° C. for 40 minutes to be cured (polymerized), and thus an undercoat layer having a film thickness at its central portion of 0.5 μm was formed.

(Preparation of Charge Generating Layer Coating Liquid)

Next, a hydroxygallium phthalocyanine crystal (charge generating substance) of a crystal form having peaks at Bragg angles (2θ±0.2°) in CuKα characteristic X-ray diffraction of 7.5°, 9.9°, 12.5°, 16.3°, 18.6°, 25.1°, and 28.3° was prepared. 10 Parts of the hydroxygallium phthalocyanine crystal, 5 parts of a polyvinyl butyral resin (trade name: S-LEC BX-1, manufactured by Sekisui Chemical Co., Ltd.), and 250 parts of cyclohexanone were loaded into a sand mill using glass beads each having a diameter of 1 mm, and the mixture was subjected to dispersion treatment for 1.5 hours. Next, 250 parts of ethyl acetate was added to the resultant to prepare a charge generating layer coating liquid.

The charge generating layer coating liquid was used for dip coating on the undercoat layer to form a coating film. It should be noted that the film thickness of the coating film was adjusted so that a layer to be obtained when the coating film was dried at 95° C. for 10 minutes had a film thickness at its central portion of 0.18 μm. After that, the removal of the coating film on the outer peripheral surface of the lower side of the substrate was performed.

A coating film-removing method was performed in the same manner as in the removal of the coating film of the undercoat layer coating liquid 1 of Example 9, and evaluation was similarly performed. It should be noted that, in the removal of the coating film, the solvent 11 spread upward through the gap at the abutting portion between each of the outer peripheral surface coating film-removing members 6*a* and the substrate 2, and the solvent 11 was constantly supplied to the abutting portion during the removal of the coating film by rubbing with the outer peripheral surface coating film-removing members 6*a*. The result of the visual observation of the degree of removal of the coating film of the charge generating layer coating liquid on the outer peripheral surface of the substrate is shown in Table 2.

Example 11

The electro-conductive layer coating liquid was used for dip coating on the cylindrical substrate 2 made of aluminum to form a coating film. After that, the removal of the coating film on the outer peripheral surface was not performed, and only the removal of the coating film on the inner peripheral surface was performed by the same method as in Example 9. The resultant was dried and thermally cured at 150° C. for 30 minutes to form an electro-conductive layer having a film thickness at its central portion of 20 μm.

Next, the undercoat layer coating liquid 1 was used for dip coating on the electro-conductive layer to form a coating film. After that, the removal of the coating film on the outer peripheral surface was not performed, and only the removal of the coating film on the inner peripheral surface was performed by the same method as that in the formation of the electro-conductive layer. The resultant was heated at 160° C. for 40 minutes to be cured (polymerized), and thus an undercoat layer having a film thickness at its central portion of 0.5 μm was formed.

Next, the charge generating layer coating liquid was used for dip coating on the undercoat layer to form a coating film. After that, the removal of the coating film on the outer peripheral surface was not performed, and only the removal of the coating film on the inner peripheral surface was performed by the same method as that in the formation of the electro-conductive layer. The resultant was dried at 95° C. for 10 minutes, and thus a charge generating layer having a film thickness at its central portion of 0.18 μm was formed.

(Preparation of Charge Transporting Layer Coating Liquid)

Next, 5 parts of a compound represented by the following formula (CTM-1), 5 parts of a compound represented by the following formula (CTM-2), and 10 parts of a polycarbonate resin having a structural unit represented by the following formula (B1-1) were dissolved in 50 parts of monochlorobenzene to prepare a charge transporting layer coating liquid.

The charge transporting layer coating liquid was used for dip coating on the charge generating layer to form a coating film. It should be noted that the film thickness of the coating film was adjusted so that a layer to be obtained when the coating film was dried at 120° C. for 30 minutes had a film thickness at its central portion of 15 μm. After that, the removal of the coating film on the outer peripheral surface of the lower side of the substrate was performed.

(CTM-1)

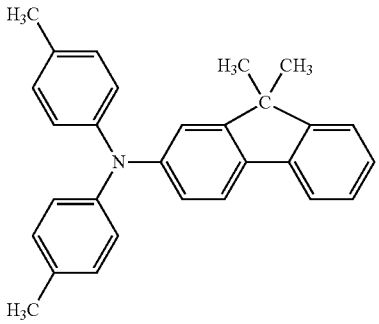

(CTM-2)

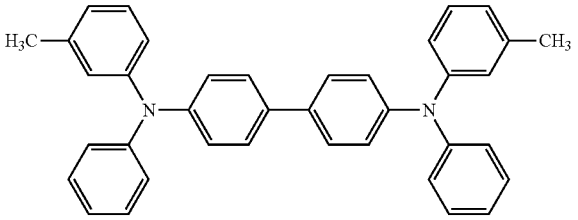

(B1-1)

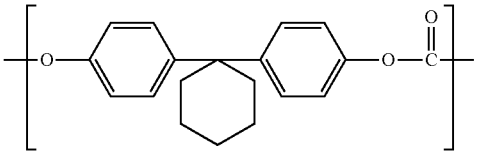

A coating film-removing method was performed in the same manner as in Example 5 except for using monochlorobenzene as the solvent 11 and setting the removal time to each of 30 seconds and 60 seconds, and evaluation was similarly performed. It should be noted that, in the removal of the coating film, the solvent 11 spread upward through the gap at the abutting portion between each of the outer peripheral surface coating film-removing members 6*a* and the substrate 2, and the solvent 11 was constantly supplied to the abutting portion during the removal of the coating film by rubbing with the outer peripheral surface coating film-removing members 6*a*. The result of the visual observation of the degree of removal of the coating film of the charge transporting layer coating liquid on the outer peripheral surface of the substrate is shown in Table 2.

TABLE 2

| Example | Coating film removal time | |
|---|---|---|
| | 30 seconds | 60 seconds |
| Example 8 | B | A |
| Example 9 | A | A |

TABLE 2-continued

| Example | Coating film removal time | |
|---|---|---|
| | 30 seconds | 60 seconds |
| Example 10 | A | A |
| Example 11 | B | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-014328, filed Jan. 28, 2015, which is hereby incorporated by reference herein in its entirety.

What is claimed is:

1. A manufacturing method for an electrophotographic photosensitive member including forming a coating film of an electrophotographic photosensitive member coating liquid on a cylindrical substrate by a dip coating method, the manufacturing method comprising removing, after the forming the coating film of the electrophotographic photosensitive member coating liquid on the cylindrical substrate by the dip coating method, the coating film present on a lower side of the cylindrical substrate in a longitudinal direction by a coating film-removing method, wherein the coating film-removing method includes supporting the cylindrical substrate having formed thereon the coating film of the electrophotographic photosensitive member coating liquid in a vertical direction, and removing the coating film at a portion to be subjected to coating film removal present on the lower side of the cylindrical substrate in the longitudinal direction through use of a coating film-removing member, and the coating film-removing method further comprises:

a solvent-supplying step of supplying a solvent to an inside of the cylindrical substrate from an opening through which the solvent is discharged;

an outer peripheral surface coating film-removing member abutment step of causing, through use of, as the coating film-removing member, an outer peripheral surface coating film-removing member configured to remove the coating film at the portion to be subjected to coating film removal in an outer peripheral surface of the cylindrical substrate, the outer peripheral surface coating film-removing member to abut against a region ranging from an upper end to a lower end of the coating film at the portion to be subjected to coating film removal in the outer peripheral surface of the cylindrical substrate; and an outer peripheral surface coating film-removing step of removing, under a state in which the outer peripheral surface coating film-removing member abuts against the region ranging from the upper end to the lower end of the coating film at the portion to be subjected to coating film removal in the outer peripheral surface of the cylindrical substrate, the coating film at the portion to be subjected to coating film removal in the outer peripheral surface through rubbing by relatively rotating the cylindrical substrate and the outer peripheral surface coating film-removing member while supplying the solvent, which is supplied to the inside of the cylindrical substrate and then flows to a lower end of the cylindrical substrate, to an abutting portion between the coating film at the portion to be subjected to coating film removal in the outer peripheral surface and the outer peripheral surface coating film-removing member.

2. The method according to claim 1, wherein the electrophotographic photosensitive member coating liquid is an undercoat layer coating liquid.

3. The method according to claim 2, wherein the undercoat layer coating liquid contains an electron transporting substance having a polymerizable functional group, a cross-linking agent, and a thermoplastic resin.

4. The method according to claim 1, wherein, in the solvent-supplying step in the coating film-removing method, the opening through which the solvent is discharged is inserted into the inside of the cylindrical substrate to supply the solvent to the inside of the cylindrical substrate.

5. The method according to claim 1, wherein, in the outer peripheral surface coating film-removing member abutment step and the outer peripheral surface coating film-removing step in the coating film-removing method, the causing the outer peripheral surface coating film-removing member to abut against the region ranging from the upper end to the lower end of the coating film at the portion to be subjected to coating film removal in the outer peripheral surface of the cylindrical substrate comprises causing the coating film-removing member to abut so that a lower end of the outer peripheral surface coating film-removing member is positioned below the lower end of the cylindrical substrate.

6. The method according to claim 1, wherein the coating film-removing method further comprises:

an inner peripheral surface coating film-removing member abutment step of causing, through use of, as the coating film-removing member, the outer peripheral surface coating film-removing member and an inner peripheral surface coating film-removing member configured to remove the coating film at the portion to be subjected to coating film removal in an inner peripheral surface of the cylindrical substrate, the inner peripheral surface coating film-removing member to abut against the coating film at the portion to be subjected to coating film removal in the inner peripheral surface of the cylindrical substrate; and an inner peripheral surface coating film-removing step of removing, under a state in which the inner peripheral surface coating film-removing member abuts against the coating film at the portion to be subjected to coating film removal in the inner peripheral surface of the cylindrical substrate, the coating film at the portion to be subjected to coating film removal in the inner peripheral surface through rubbing by relatively rotating the cylindrical substrate and the inner peripheral surface coating film-removing member.

7. The method according to claim 6, wherein the outer peripheral surface coating film-removing member and the inner peripheral surface coating film-removing member are caused to abut against the cylindrical substrate in such a manner that overlapping of an abutting portion between the cylindrical substrate and the outer peripheral surface coating film-removing member, and an abutting portion between the cylindrical substrate and the inner peripheral surface coating film-removing member at the same position on a circumference of the cylindrical substrate is avoided.

8. The method according to claim 1, wherein the outer peripheral surface coating film-removing member to be used is an outer peripheral surface coating film-removing member having a blade shape.

* * * * *